United States Patent [19]

Massion

[11] 4,289,174

[45] Sep. 15, 1981

[54] POSITIVE SEALING ASSEMBLY FOR HAND OPERATED STRAPPING TOOL

[75] Inventor: Robert J. Massion, Cary, Ill.

[73] Assignee: Signode Corporation, Glenview, Ill.

[21] Appl. No.: 77,940

[22] Filed: Sep. 24, 1979

[51] Int. Cl.[3] ..... B21F 9/02

[52] U.S. Cl. ..... 140/93.4

[58] Field of Search ..... 140/93 D, 93 R, 93.4, 140/93.2, 123.5; 81/313

[56] References Cited

U.S. PATENT DOCUMENTS

| | | | |
|---|---|---|---|
| 3,039,336 | 6/1962 | Kobiella | 81/313 X |
| 3,322,008 | 5/1967 | Filia | 81/313 |
| 3,360,017 | 12/1967 | Vilcins | 140/93.4 |
| 3,572,398 | 3/1971 | Sansum | 140/93.4 |
| 3,769,859 | 11/1973 | Sykes | 81/313 X |
| 4,015,643 | 4/1977 | Cheung | 140/93.4 |

*Primary Examiner*—Richard B. Lazarus

*Attorney, Agent, or Firm*—Dressler, Goldsmith, Shore, Sutker & Milnamow

[57] ABSTRACT

A strapping tool of the type which crimps or notches a seal around overlapping strap ends extending in opposite directions in a tensioned strap loop around an article being tied. The tool has a frame, a sealer jaw assembly mounted for at least opening and closing movement about the seal and an actuator therefor. The actuator includes a member adapted to be rotated about an axis in a first direction to a predetermined angle to fully close the jaw assembly and adapted to be rotated about the axis in a second, opposite direction to open the jaw assembly. A pawl is mounted on the frame for pivoting in the first and second directions and is biased against rotation in both directions to an initial, unengaged position when the jaw assembly is both fully closed and fully opened. An engaging means is connected to the actuating member and positioned for pivoting the pawl in the second direction when the actuating member is rotated in the first direction to close the jaw assembly and for engaging the pawl in a position pivoted from its initial position to prevent rotation of the actuating member in the second direction until the actuating member has been rotated in the first direction through the predetermined angle to carry the engaging means past the pawl.

17 Claims, 12 Drawing Figures

26
16
10
2.
3.
18
3.
22
24
17
12
C
35
32
20
20
28
U
S
14R
2.
14
34
14F
L
P

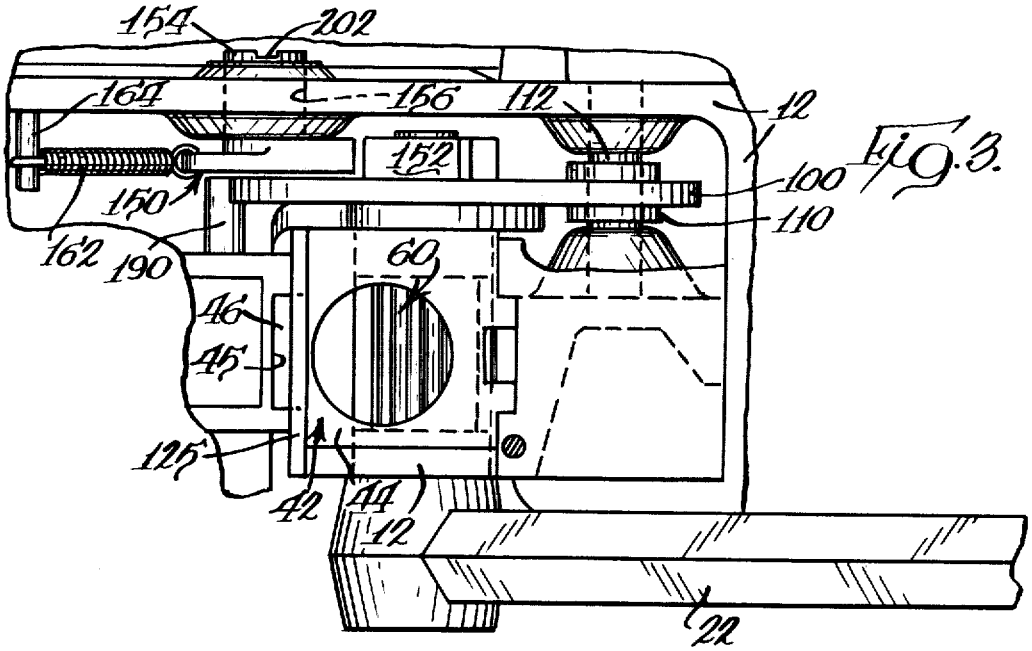
Fig. 3.
Fig. 4.
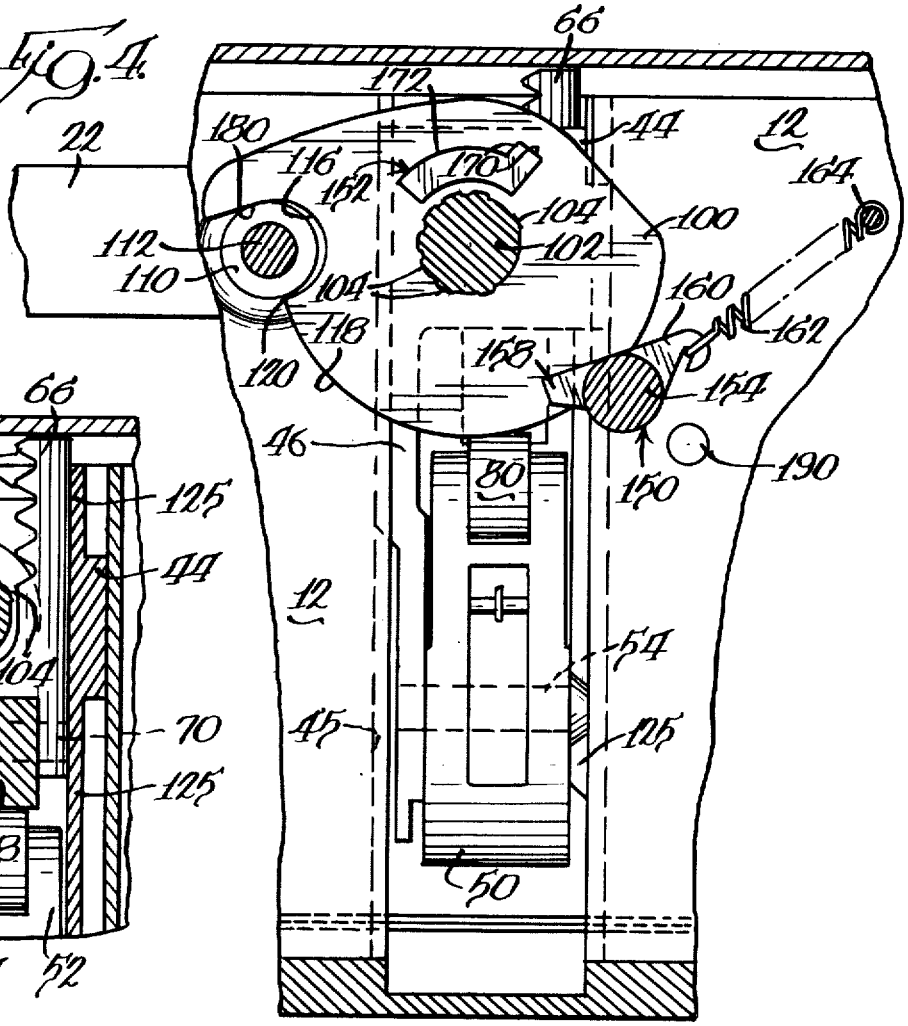
Fig. 5.
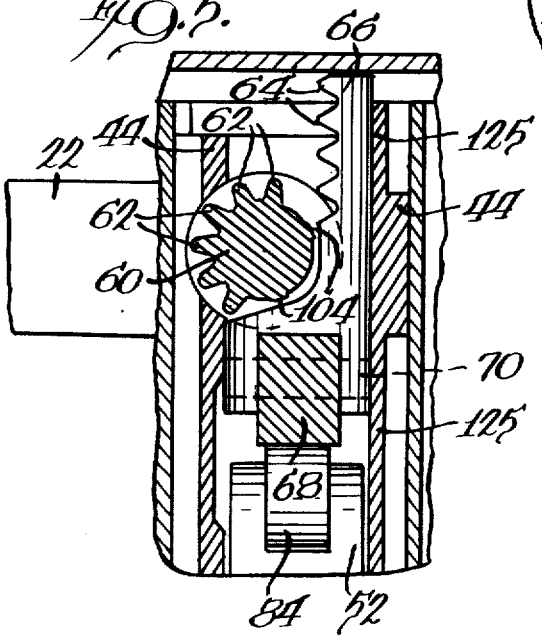

22
124
180
110
112
118
116
12
162
152
172
104
160
150
102
158
170
100
68
80
46
50
60
44
62
64
66
52
18
201
200
190
88
90
86
70
84
82
59
54
56
20
U
C
L

POSITIVE SEALING ASSEMBLY FOR HAND OPERATED STRAPPING TOOL

DESCRIPTION

1. Technical Field

This invention relates to self-contained tools for sealing a tensioned loop of strap or other ligature tightly about an article.

2. Background of the Invention

The assembly of the present invention is particularly well suited for certain types of strapping tools wherein a handle is rotated to actuate a jaw assembly to apply a seal to the strap loop. In some of these types of tools overlapping upper and lower ends of the strap loop are first engaged respectively by a feed wheel and an anvil to enable rotation of the feed wheel to advance the upper strap end while the anvil holds the lower strap end stationary. After a suitable tension has been applied to the strap loop, the tool sealer handle is rotated through a predetermined arc to apply a generally U-shaped metal seal to the overlapping strap ends and to crimp the seal tight about the overlapping strap ends. The trailing portion of the strap may be subsequently severed by the tool. Such a tool is described in the U.S. Pat. No. 3,360,017 to Vilcins.

The assembly of the present invention could also be used with certain types of lever-operated tools that merely apply a seal to a previously formed loop around an article.

With these types of tools, the handle lever must be moved far enough by the operator, to the end of a predetermined arc of rotation, for the seal to be fully crimped. Return of the lever before the seal is fully crimped will lead to an unsealed or incompletely sealed joint.

Various positive sealing mechanisms have been developed for preventing premature handle return in non-tensioning, lever-operated strap sealing tools. See, for example, the U.S. Pat. No. 3,039,336 to Kobiella, the U.S. Pat. No. 3,040,606 to Ericsson, and the U.S. Pat. No. 3,089,366 to Haraden. However, it would be desirable to provide a less complicated positive sealing mechanism and one that would be especially suitable for use in a combination strap tensioning and sealing tool, particularly such a tool that incorporates a rack and pinion jaw assembly actuator.

SUMMARY OF THE INVENTION

The assembly of the present invention is used in a strapping tool of the type which crimps a seal around overlapping plastic strap ends extending in opposite directions in a tensioned strap loop around an article being tied. In the preferred embodiment the tool has a frame for supporting the various mechanisms, including a sealer jaw assembly mounted for at least opening and closing movement relative to the overlapping strap ends to which the seal is applied. The frame also supports a handle-operated sealer jaw assembly actuator to effect operation of the sealer jaw assembly.

In particular, the sealer jaw assembly actuator includes a reciprocable drive member adapted to be moved between a retracted position in which the jaw assembly is opened relative to the seal and an extended position in which the jaw assembly is engaged to crimp the seal around the overlapping strap ends. A rack is fixed to the drive member and a pinion is mounted for engaging the rack for at least a portion of the pinion circumference. The pinion is connected to the handle and is adapted to be rotated about its axis in a first direction to move the drive member to the extended position when the pinion is engaged with the rack and is adapted to be rotated about its axis in a second, opposite direction to move the drive member to the retracted position when the pinion is engaged with the rack.

A pawl is mounted on the frame for pivoting in the first and second directions and is biased against rotation in either direction to an initial position. A novel means is mounted on the pinion for rotating therewith to pivot the pawl in the second direction when the pinion is rotated in the first direction and for preventing rotation of the pinion in the second direction by the handle unless and until the pinion has continued to be rotated through a predetermined angle. This angle corresponds to the amount of rotation of the pinion to actuate the sealer jaw assembly as necessary to fully crimp the seal. Thus, the handle lever operating the pinion cannot be moved back to the seal-release position until the seal has been fully formed or until the pawl is manually released.

The novel combination of elements in accordance with the present invention yields desirable and beneficial results—results which are not only new and different, but which also provide a substantial improvement over the prior art.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification and in which like numerals are employed to designate like parts throughout the same.

FIG. 3 is an enlarged, fragmentary, plan view taken generally along the plane 3—3 in FIG. 1 with certain hidden mechanisms illustrated in dashed lines and with certain portions cut away to more clearly illustrate the interior mechanisms;

FIG. 4 is a fragmentary, cross-sectional view taken generally along the plane 4—4 in FIG. 2;

FIG. 5 is a fragmentary, cross-sectional view taken generally along the plane 5—5 in FIG. 2;

DESCRIPTION OF THE PREFERRED EMBODIMENT

This invention may be used in many different forms. This specification and the accompanying drawings disclose only one specific form as an example of the use of the invention. The invention is not intended to be limited to the embodiment illustrated, and the scope of the invention will be pointed out in the appended claims.

The precise shapes and sizes of the components herein described are not essential to the invention unless otherwise indicated.

For ease of description, the apparatus of this invention will be described in normal operating position and terms such as upper, lower, horizontal, etc., will be used with reference to this normal operating position. It will be understood, however, that the apparatus of this invention may be manufactured, stored, transported and sold in an orientation other than the normal operating position described.

The apparatus of this invention has certain conventional mechanisms, the details of which, though not fully illustrated or described, will be apparent to those having skill in the art and an understanding of the necessary functions of such mechanisms.

Figure 1:
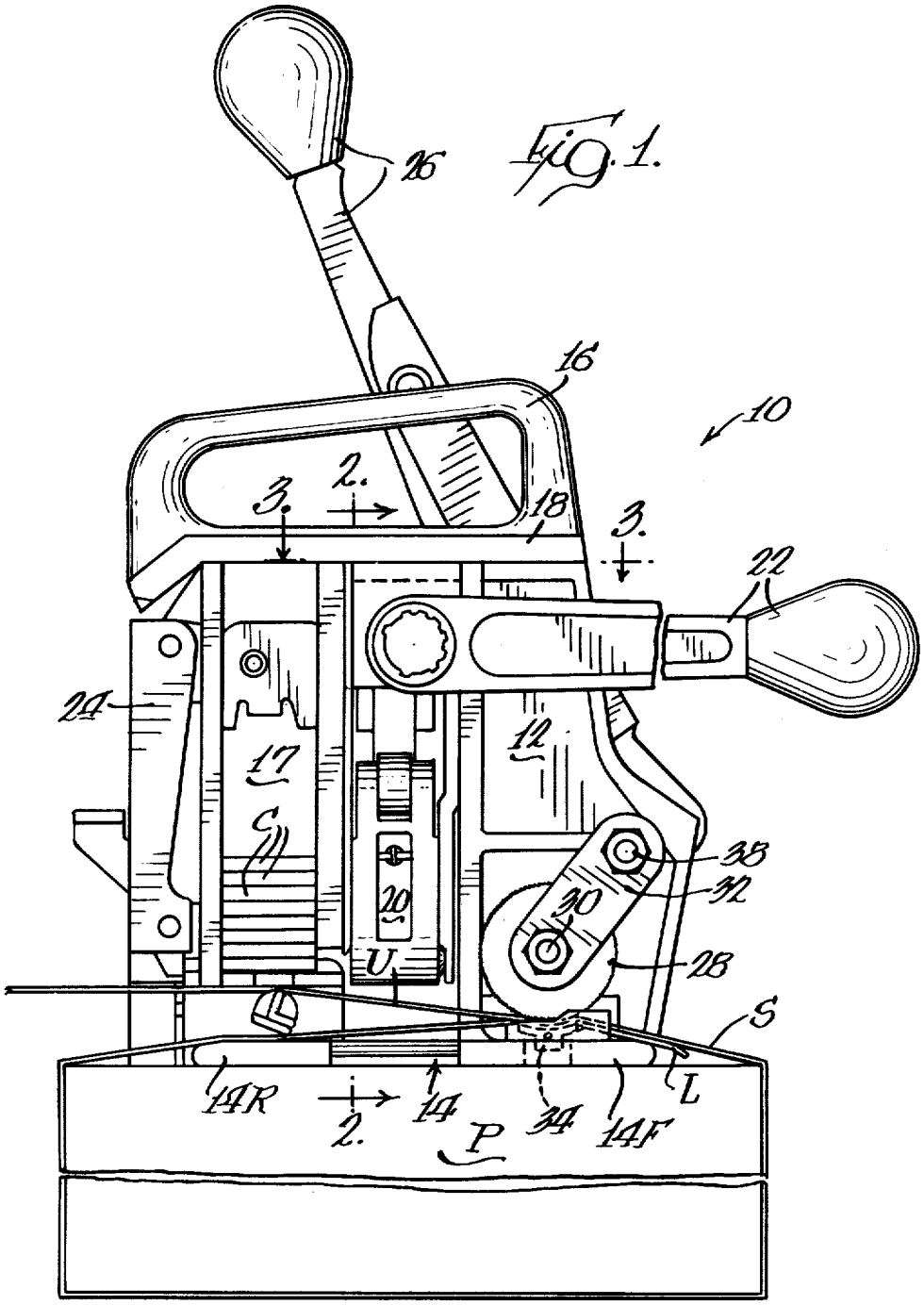
FIG. 1 is a side elevational view of the relevant parts of a strap tensioning tool shown equipped with the positive sealing assembly in accordance with the present invention.

Referring now to the drawings, in FIG. 1, the relevant elements of a typical strap tensioning and sealing tool 10 are shown. The novel mechanisms of the present invention, in the embodiment illustrated, are specially adapted for use with, and are incorporated in, a modification of a strapping tool illustrated and described in the U.S. Pat. No. 4,015,643 to Cheung. Hence, some of the mechanisms of the strapping tool 10 are identical to those illustrated in that patent and operate in the same manner. Such mechanisms include the pivotably mounted gripper plug assembly, the tensioning assembly (which is described in more detail the U.S. Pat. No. 3,998,429 to Cheung), the seal magazine mechanism, the seal feeder mechanism, and the seal crimping jaw assembly mechanism, the last three listed mechanisms being also described in more detail in the U.S. Pat. No. 3,360,017 to Vilcins. These various conventional mechanisms will be described in only so much detail as is necessary for a complete understanding of the present invention and reference is directed to the above-identified patents for a more complete description of the conventional mechanisms.

Briefly, the tool 10 includes a rigid main frame 12 having an elongated base 14 shown contacting a package P having a strap S looped thereabout. Opposite ends of the loop of strap S are shown extending along the top of the base 14 and constitute overlapping upper and lower strap ends U and L, respectively. The base 14 has a forward contact foot 14F and a rearward contact foot 14R.

The main frame has a top 18, a carrying handle 16, and a seal magazine 17 that extends downwardly from the top and terminates above the rear foot 14R. The seal magazine 17 defines a chamber which houses the usual form of a stack of seals C for one by one delivery to the bottom of the magazine. In front of the seal magazine 17 is the sealer jaw assembly 20 of the conventional spring-opened type which will be described in more detail hereinafter.

In the tool illustrated the jaw assembly is operable by counterclockwise rotation of a sealer handle 22, as viewed in FIG. 1, to effect a lowering of the jaw assembly and the crimping of the seal by the jaw assembly. A seal from the stack of seals C is fed from the bottom of the seal magazine 17 to the sealer jaw assembly 20 by an ejector lever 24 in a well-known manner. In operation, after the strap loop is tensioned as described below, a seal C is forced upon the overlapping strap ends U and L and crimp-folded or crimped in place by the jaw assembly, thereby fastening the two strap-loop ends U and L together.

A feed wheel 28 is mounted from the main frame 12 for bodily movement toward and away from the upwardly facing surface region of the main frame base forward contact foot 14F. The overlapping loop strap ends U and L can then be inserted underneath the feed wheel 28 for initial strap loading of the tool. The tensioning tool has a tensioning handle 26 which includes a feed wheel rotary drive means 27 (FIG. 2) which is illustrated and described in detail in the aforementioned U.S. Pat. No. 3,998,429 to Cheung. However, any suitable tensioning mechanism may be employed with a strapping tool 10 incorporating the novel mechanisms of the present invention. The rotary drive means 27 is operatively connected to drive the feed wheel 28 in a single rotary clockwise direction (FIG. 1) to draw the upper strap end in a loop-tightening direction, that is, to the left, as viewed in FIG. 1. In the tool illustrated, the rotary drive means 27 acts through the feed wheel shaft 30 and is movable bodily with the feed wheel 28.

A movement of the feed wheel 28 between the strap load and strap release positions is effected by a pivotal arm 32 which is pivoted on a cross-shaft 38 carried in the main frame 12 and which carries the feed wheel shaft 30 for arcuate swinging movement to approach the gripper plug 34 (illustrated in dashed lines in FIG. 1) in the base 14F along a selected energizing angle which is inclined from the vertical as is more fully described in the aforementioned U.S. Pat. No. 4,015,643 to Cheung.

With reference now to FIGS. 2, 3, 4 and 5, the mechanism for crimping the seal about the overlapping strap ends will next be described. The frame 12 is adapted to receive the sealer jaw assembly 20 and a sealer jaw assembly actuator 40 to which the sealer jaw assembly 20 is mounted. The sealer jaw assembly actuator 40 includes a reciprocative support block 42 as best illustrated in FIGS. 3 and 4 which carries other elements of the actuator as will be described hereinafter. The support block 42 is adapted to slide within the frame 12 and has an upper housing portion 44 and an elongated member 46 depending from the housing portion 44. As best illustrated in FIGS. 3 and 4, the frame 12 defines a channel 45 in which the upper portion of elongated member 46 is received to accommodate the vertically sliding movement of block 42.

Figure 2:
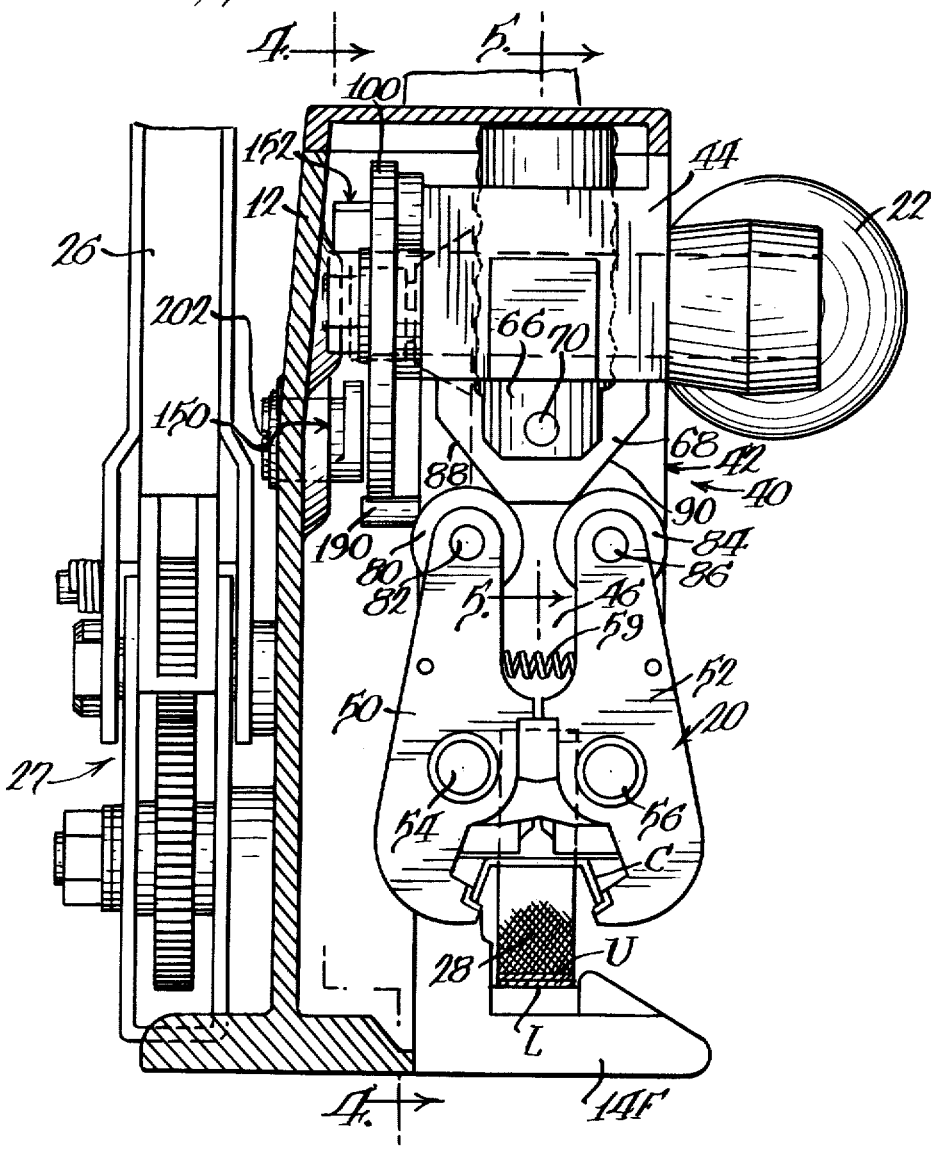
FIG. 2 is an enlarged, fragmentary, cross-sectional view taken generally along the plane 2—2 in FIG. 1.

As best illustrated in FIG. 2, the jaw assembly 20 has a pair of opposing jaws 50 and 52 mounted about pins 54 and 56, respectively, projecting from the lower portion of elongated member 46. The jaws 50 and 52 are normally biased to an open position by a tension spring 59. Since the jaw assembly 20 is mounted to the vertically reciprocative support block 42, the jaw assembly 20 may be moved, by means described in detail hereinafter, between an elevated position where the jaw assembly 20 is positioned above the strap ends as illustrated in FIG. 2 to receive the seal C and a lowered position where the jaw assembly 20 is positioned to hold the seal C around the overlapping strap ends as illustrated in FIG. 8.

The support housing 44 of the support block 42 carries an actuating member or pinion gear 60 having an integral shaft 102, one end of which is fixed to the sealer handle 22, so that swinging movement of the handle 22 from the forwardly extending horizontal position illustrated in FIG. 1, in a counterclockwise direction, to a rearwardly extending position, will rotate the pinion 60 relative to the housing 44. The pinion 60 has teeth 62 extending in an arc only partially around the pinion. The teeth 62 are adapted to engage the teeth 64 (FIG. 5) of a rack 66 slidably disposed within the housing portion 44 of the support block 42. As best illustrated in FIGS. 2 and 5, the rack 66 carries a wedge member 68 which is secured to the rack 66 by means of pin 70. The wedge 68 is adapted to actuate the jaw assembly 20 to close the jaws 50 and 52 about the seal C. To this end, jaw 50 has a roller 80 mounted about pin 82 to its upper, bifurcated end and jaw 52 has a roller 84 mounted about pin 86 to its upper, bifurcated end. The wedge member 68 defines slanting drive surfaces 88 and 90 which are adapted to contact and ride against the rollers 80 and 84, respectively, whereby the upper ends of the jaws 50 and 52, respectively, are pivoted outwardly against the bias of spring 59 so that the jaws close about the seal as best illustrated in FIG. 12.

Figure 8:
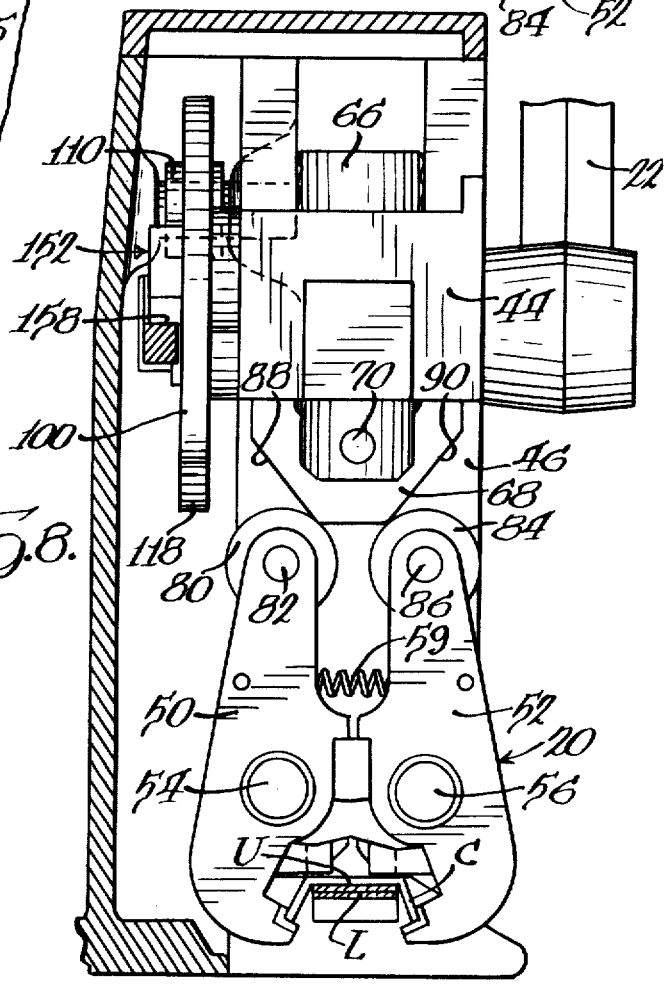
FIG. 8 is a fragmentary, cross-sectional view taken generally along the plane 8—8 in FIG. 6 and illustrating the jaw assembly moved to its lowermost position to place the seal on top of the overlapping strap ends.

During the sealing operation, the jaw assembly 20 must first be moved from the elevated position illustrated in FIG. 2 to the lowered position illustrated in FIG. 8 before the jaws are closed to crimp the seal C about the overlapping strap ends U and L. To this end, a cam plate 100 is secured to the pinion shaft 102 (as best illustrated in FIGS. 3 and 4), with a plurality of projecting keys 104. A roller 110 mounted on shaft 112 to frame 12 is provided adjacent the cam plate 100. The cam plate 100 has a generally concave slot 116 (relative to the roller 110) and a generally circular convex guide surface 118 (relative to the roller 110), which surfaces merge at a convex camming surface 120. During tensioning, when the handle 22 is in the forwardly extending horizontal position illustrated in FIGS. 1 and 4, the roller 110 is received in the generally concave slot 116.

Figure 6:
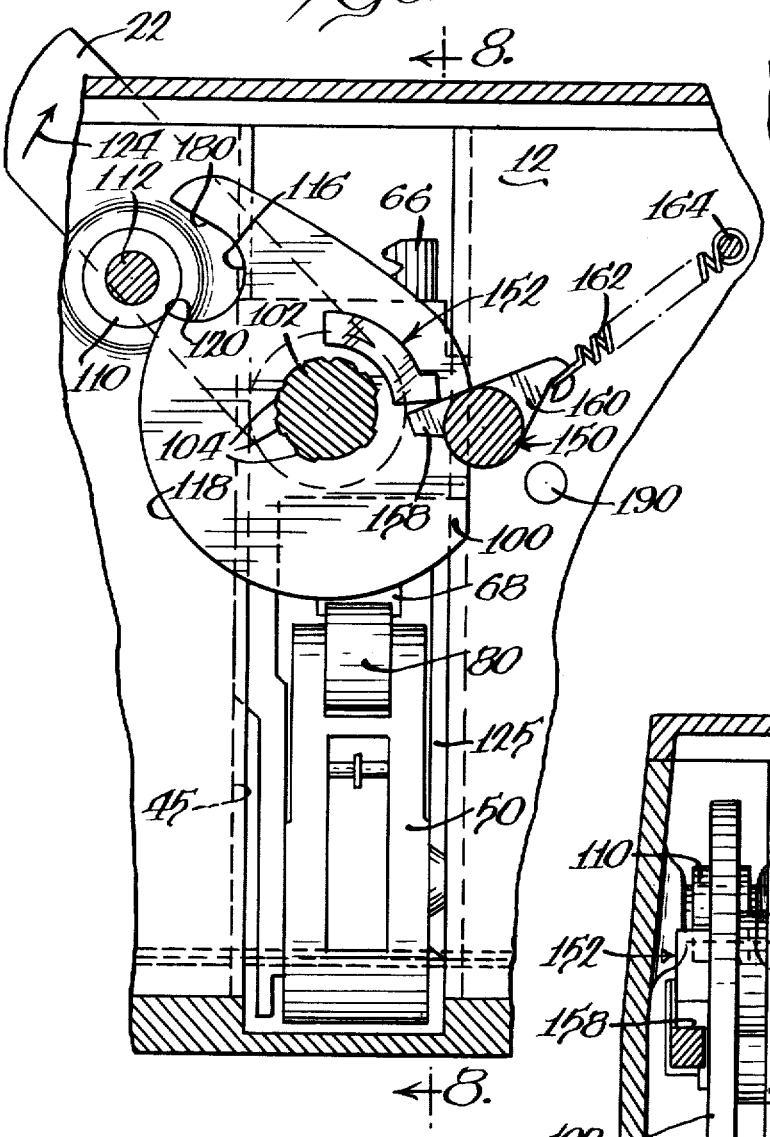
FIG. 6 is a fragmentary, cross-sectional view similar to FIG. 4 but showing the sealer handle being rotated through a first portion of its swinging movement.

After tensioning, when the sealer handle 22 is operated, as by swinging it upwardly in the direction of arrow 124 in FIG. 6, the pinion shaft 102 is rotated and the cam plate 100 is rotated along with the pinion shaft 102 so that the generally convex camming surface 120 engages the roller 110. This necessarily forces the cam plate 100 and pinion shaft 102 downwardly, along with the support block 42 in which the pinion shaft 102 is mounted. In the position illustrated in FIG. 6, the camming surface 120 has been rotated, relative to the axis of the pinion shaft 102 and the axis of the roller shaft 112, such that further rotation in the direction of arrow 124 would effect no further downward movement of the cam plate 100 and hence of the support block 42. At this point, the jaw assembly 20 is in the lowered position illustrated in FIG. 8 wherein the seal C, previously fed to the jaw assembly in the raised position (FIG. 2), is now held by the jaws tight against the overlapping strap ends U and L. A conventional cutter 125 (FIG. 6) is carried with the jaw assembly 20 by block 42 to the lowered position for severing the trailing portion of the strap loop at this point.

Figures 9, 10, 11, 12:
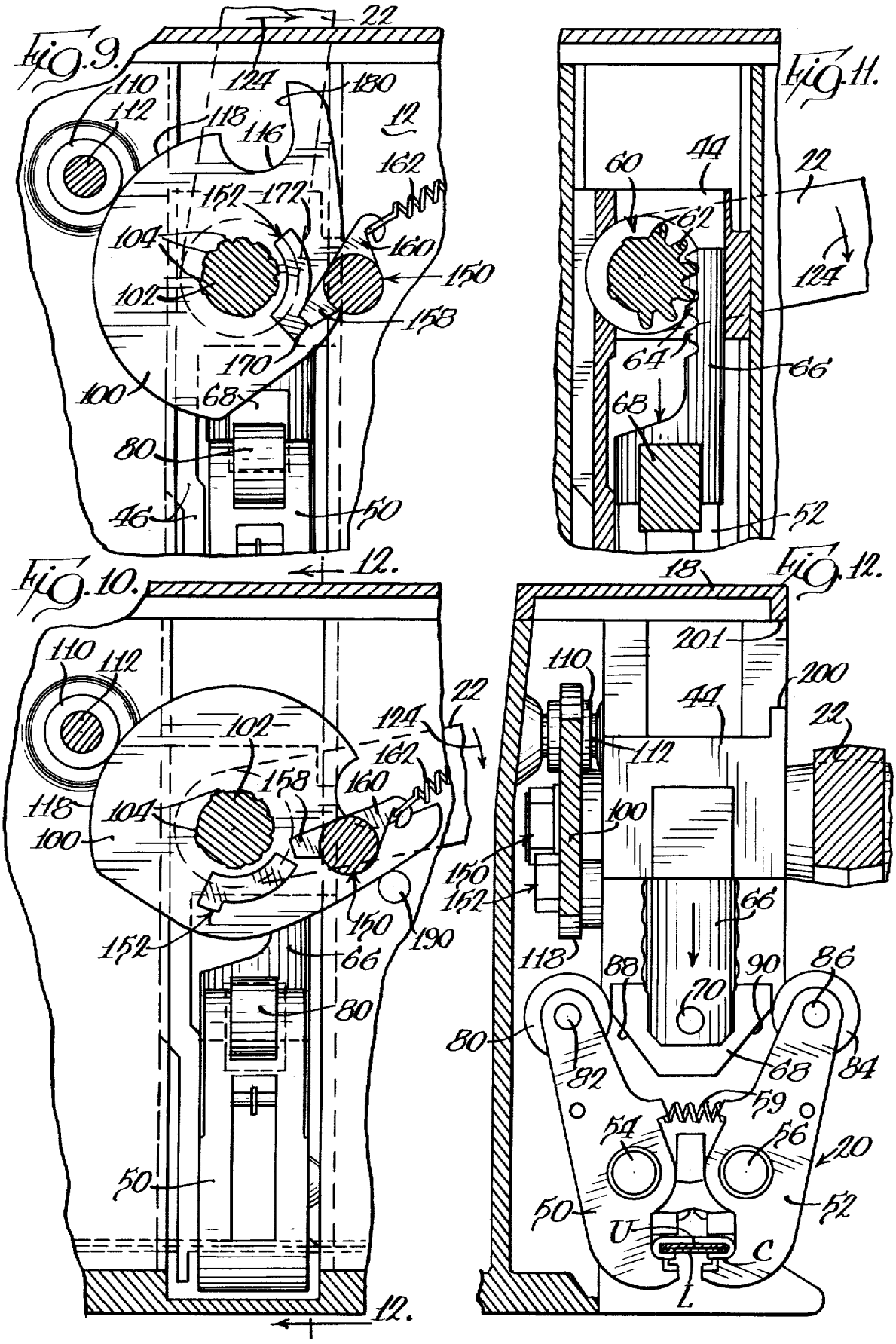
FIG. 9 is a fragmentary, cross-sectional view similar to FIG. 6 but showing the sealer handle rotated through a further angle to operate the sealer jaws assembly to begin crimping the seal about the overlapping strap ends.
FIG. 10 is a fragmentary, cross-sectional view similar to FIG. 6 but showing the sealer handle rotated to its maximum operating position wherein the seal has been fully crimped about the overlapping strap ends.
FIG. 11 is a fragmentary, cross-sectional view similar to FIG. 5 but illustrating the mechanisms in their positions corresponding with FIG. 10.
FIG. 12 is a fragmentary, cross-sectional view taken generally along the plane 12—12 in FIG. 10.

Continued rotation of the handle lever 22 in the direction of arrow 124, as illustrated in FIG. 9, brings the guide surface 118 into contact with the roller 110. Since the guide surface 118 extends along a circular arc at a constant radius from the axis of the pinion shaft 102, the cam plate 100 is no longer forced downwardly. Thus, continued rotation of the pinion shaft 102 and guide plate 100 in the direction of arrow 124 effects no change in elevation of the jaw assembly 20 so that the jaw assembly 20 is maintained in the lowered position illustrated in FIG. 8.

During the downward movement of the sealer jaw assembly actuator 40 (comprising handle 22, pinion 60, pinion shaft 102, cam 100, support block 42, rack 66 and wedge 68), as well as of the sealer jaw assembly 20, the pinion 60 is not engaged with the rack 66. Specifically, with reference to FIGS. 5, 6 and 7, it can be seen that the teeth 62, extending only partially around the circumference of pinion 60, do not engage the teeth 64 of rack 66 until the sealer jaw assembly actuator 40 has been forced to the lowered position where the seal C is urged against the overlapping strap ends U and L. At the point where the cam plate downward movement is terminated and where the cam plate guide surface 118 engages roller 110, the first tooth 62' (FIG. 7) just begins to engage the teeth 64 on the rack 66. Thus, continued rotation of the pinion 60 in the direction of arrow 124 causes the pinion teeth to mesh with the rack teeth and move the rack 66 downwardly relative to the pinion 60 and relative to the support block 42. As explained previously, downward movement of the rack 66 actuates the jaw assembly 20 to crimp the seal C about the overlapping strap ends U and L.

During the portion of the movement of handle 22 when the rack 66 is being moved downwardly to actuate the jaw assembly 20, it is important to continue the downward movement until the jaws 50 and 52 have been fully closed to effect a maximum crimp of the seal C about the overlapping strap ends U and L. Owing to the resistance of the seal C to crimping, which resistance is transmitted through the mechanisms to handle 22 as a reaction force, the operator of the tool may think that he has fully crimped the seal when in fact the seal is only partially crimped. Under such an erroneous belief, the operator may attempt to return the handle 22 to the normal, forwardly extending horizontal position and to remove the tool from the strap loop. According to the present invention, a novel mechanism is provided for preventing this occurrence.

With reference to FIGS. 2, 3 and 4, a pawl 150 is mounted to frame 12 and is adapted to be engaged by an engaging means or engagement member 152 mounted to cam plate 100 for preventing rotation of the cam plate in the direction which would raise the jaw assembly 20 unless and until the pinion 60 has been rotated through a predetermined angle as will be explained in more detail hereinafter.

The pawl 150 has an integral shaft 154 which is received within bore 156 of frame 12 and which is rotatable therein. The pawl 150 has an engaging end 158 and a non-engaging end 160 opposite the engaging end 158. The pawl 150 is biased to an initial unengaged position by a tension spring 162 connected to the non-engaging end 160 of the pawl 150 and to a pin 164 projecting from the frame at the other end. The pawl 150 may thus be pivoted or rotated about the axis of shaft 154 in either of two opposite directions, so long as the biasing effect of spring 162 is overcome.

The engagement member 152 has an abutment surface 170 and a guide surface 172. The guide surface 172 is in the form of a generally circular arc or cylindrical section and the abutment surface 170 projects outwardly from the guide surface 172. The engagement member 152 does not extend completely around the axis of pinion shaft 102. However, preferably the guide surface 172 defines a locus of generally constant radius from the axis of pinion shaft 102 throughout its arc length.

During operation of the lever 22 to crimp the seal about the overlapping strap ends, the engagement member 152 is initially out of contact with the pawl 150 and the pawl 150 is in its normally biased initial position as illustrated in FIG. 4. After the handle 22 has been swung through an arc sufficient to move the jaw assembly 20 to the lowered position (as illustrated in FIGS. 6 and 8) the engagement member 152 engages the pawl 150 and further rotation of handle 22 moves the engagement member 152 against the pawl 150 to pivot the pawl about its axis of rotation (and in a direction of rotation opposite to that of the rotation of the pinion shaft 102 and cam plate 100). As the teeth 62 of the pinion 60 begin to engage the teeth 64 of rack 66 (FIG. 7) the engaging end 158 of pawl 150 is urged outwardly and past the abutment surface 170 of the engagement member 152 whereupon it is urged by spring 162 against the engagement member guide surface 172. In this position, illustrated in FIG. 9, the swinging of handle 22 back towards the position where the seal would be released (opposite to the direction of arrow 124) is prevented by the interaction of pawl 150 with engagement member 152. However, this handle return lock can be overcome at this point by a special manipulation if desired. Specifically, the integral pawl shaft 154 can be rotated in a counterclockwise direction as viewed in FIG. 9 by means of a screwdriver inserted in a slot 202 in shaft 154 (the slot 202 visible in FIGS. 2 and 3).

Continued rotation of the handle 22 in the seal crimping direction (arrow 124 in FIG. 9) will carry the engagement member 152 in an orbit about the axis of pinion shaft 102 such that the guide surface 172 continuously maintains the pawl 150 in the position pivoted away from the initial position illustrated in FIG. 4. Thus, at any time during the sealer jaw assembly actuation process before the seal is fully crimped, the handle 22 can be swung only for a short distance in the opposite direction—until the pawl 150 again engages the abutment surface 170 of the engagement member 152 and prevents further reverse rotation of the handle lever 22.

A pin 190 is provided on frame 12 as illustrated in FIG. 10 to engage cam plate 100 and prevent rotation beyond the point where the seal C has been fully crimped by the jaw assembly 20. At this point, the engagement member 152 has just rotated past and out of engagement with the pawl 150 whereupon the pawl 150 is pivoted back to the initial, unengaged position under the urging of the biasing spring 162 as best illustrated in FIG. 10. At this point, rotation of the handle 22 in the direction opposite the seal-crimping direction is permitted so that the handle can be returned to the original forwardly extending seal-release position illustrated in FIG. 1.

As the handle 22 is rotated back to the seal-release position, the engagement member 152 engages the pawl 150 and pivots it back about its axis of rotation (opposite to the direction of rotation of the handle 22 and cam plate 100) against the urging of bias spring 162. After further return movement of handle 22, the engagement member 152 then rides past the upwardly pivoted pawl 150.

Return of handle 22 to the forwardly extending horizontal seal-release position illustrated in FIG. 1 causes rotation of the pinion 60 in a direction to raise the rack 66 to pull the wedge member 68 from between the jaw rollers 80 and 84 so that the jaws 50 and 52 are returned, under the influence of tension spring 59, to the open position illustrated in FIG. 8.

Figure 7:
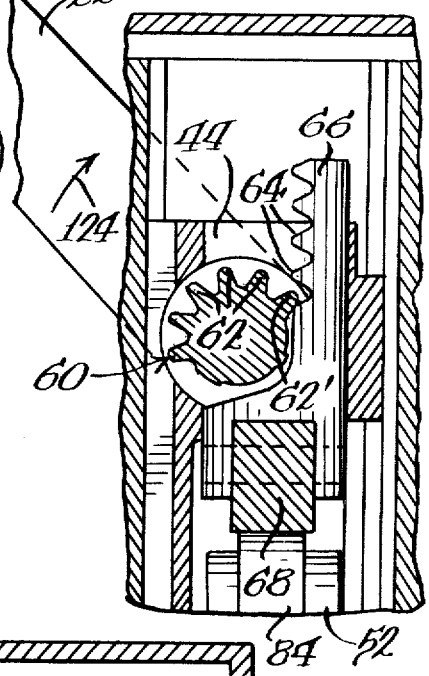
FIG. 7 is a fragmentary, cross-sectional view similar to FIG. 5 but illustrating the mechanisms in their positions corresponding with FIG. 6.

Continued movement of the handle lever 22 towards the forwardly extending position illustrated in FIG. 1 causes continued rotation of the pinion 60. However, at this point, the pinion teeth 62 are out of engagement with the rack 66 as illustrated in FIG. 7 so that the rack and hence wedge member 68 no longer move upwardly. The wedge member 68 remains supported on the rollers 80 and 84 as illustrated in FIG. 8.

Continued movement of the handle lever 22 to return it to the normal, forwardly extending position illustrated in FIG. 1 continues to rotate the pinion 60, pinion shaft 102, and cam plate 100 to bring the camming extension surface 180 into engagement with the roller 110 to thereby begin raising the entire sealer drive actuator assembly 40 and sealer jaw assembly 20 therewith. When the handle lever 22 is finally returned all the way to the forwardly extending horizontal position illustrated in FIG. 1, the cam plate 100 has rotated to bring the receiving slot 116 around the roller 110.

As best illustrated in FIG. 12, the support housing 44 has an abutment surface 200 for engaging a projection 201 on the frame top 18. Further movement of the handle 22 in the direction to raise the jaw assembly 20 is prevented by the surface 200 hitting the projection 201. At this point, the opened jaw assembly 20 is in the elevated position illustrated in FIGS. 2 and 4 and the engagement member 152 has been rotated past the pawl 150 and out of engagement therewith to the orientation illustrated in FIG. 4. This allows the pawl 150 to be pivoted back to its initial position under the influence of biasing spring 162.

From the foregoing, it will be observed that numerous variations and modifications may be effected without departing from the true spirit and scope of the novel concept of the invention. It is to be understood that no limitation with respect to specific apparatus illustrated herein is intended or should be inferred. It is, of course, intended to cover by the appended claims all such modifications as fall within the scope of the claims.

What is claimed:

1. A strapping tool of the type which crimps or notches a seal around overlapping strap ends extending in opposite directions in a tensioned strap loop around an article being tied, said tool comprising:

a main frame;

a sealer jaw assembly mounted for at least opening and closing movement about said seal relative to said frame;

a sealer jaw assembly actuator means for actuating the sealer jaw assembly; said sealer jaw assembly actuator means including (1) a reciprocative drive member adapted to be moved between a retracted position in which said jaw assembly is opened relative to said seal and an extended position in which said jaw assembly is engaged to crimp or notch said seal around the overlapping strap ends;

(2) a rack on said drive member;

(3) a pinion mounted for engaging said rack for at least a portion of its circumference and adapted to be rotated about its axis in a first direction to move said drive member to said extended position and adapted to be rotated about its axis in a second, opposite direction to move said drive member to said retracted position;

(4) a pawl mounted on said frame to pivot about an axis in said first and second directions and biased against rotation in both directions to an initial position; and (5) means mounted on said pinion for rotating therewith to pivot said pawl about the axis in said second direction when said pinion is rotated in said first direction and for engaging said pawl to prevent rotation of said pinion in said second direction during engagement with said rack unless and until said pinion has been rotated through a predetermined angle.

2. A strapping tool of the type which crimps or notches a seal around overlapping strap ends extending in opposite directions in a tensioned strap loop around an article being tied, said tool comprising:

a main frame;

a sealer jaw assembly mounted for at least opening and closing movement relative to said frame;

a sealer jaw assembly actuator means for actuating the sealer jaw assembly; said sealer jaw assembly actuator means including (1) a reciprocative drive member adapted to be moved between a retracted position in which said jaw assembly is opened relative to said seal and an extended position in which said jaw assembly is engaged to crimp or notch said seal around the overlapping strap ends;

(2) a rack on said drive member;

(3) a pinion mounted for engaging said rack and adapted to be rotated about its axis in a first direction to move said drive member to said extended position when the pinion is engaged with said rack and adapted to be rotated about its axis in a second, opposite direction to move said drive member to said retracted position when the pinion is engaged with said rack;

(4) a pawl mounted on said frame to pivot about an axis in said first and second opposite directions;

(5) means for biasing said pawl against rotation in either direction to an initial position; and (6) an engagement means secured to said pinion for rotation therewith, said engagement means having an abutment surface and a guide surface merging therewith, said abutment surface projecting outwardly from the guide surface, both said surfaces lying outwardly of the pinion axis and extending less than completely around the axis, said engagement means located relative to said pawl to engage and pivot said pawl about the axis against the urging of said biasing means in said second direction when said pinion and engagement means are rotated in said first direction, said guide surface located relative to said pawl to maintain said pawl in a position pivoted in said second direction from said initial position for less than a complete rotation of said pinion and engagement means in said first direction, said abutment surface adapted to engage said pawl when the pawl is in a position pivoted by said guide surface in said second direction away from said initial position for preventing rotation of said pinion and engagement means in said second direction unless and until said engagement means has been rotated in said first direction past said pawl and out of engagement therewith whereby said pawl is urged by said biasing means to said initial position and may thereafter be engaged by said engagement means rotating in said second direction to pivot said pawl about the axis against the urging of said biasing means in said first direction.

3. The strapping tool in accordance with claim 2 in which said sealer assembly actuator means further includes a reciprocative support block slidably disposed within said frame and adapted for movement between a first elevated position and a second lowered position; in which said pinion is mounted to said support block for rotation relative thereto and for being carried in reciprocating movement therewith; in which said drive member and rack are slidably disposed relative to said support block; and in which said sealer jaw assembly is secured to said mounting block for being carried in reciprocating movement therewith whereby, when said support block is in said elevated position, said jaw assembly is positioned above said strap ends to receive said seal and when said support block is in said lowered position, said jaw assembly is positioned to hold said seal around said overlapping strap ends.

4. The strapping tool in accordance with claim 3 in which said tool further includes a roller fixed to said frame and a cam plate fixed to said pinion for rotation therewith, said cam plate defining a camming surface adapted to engage said roller, and said tool further including a handle fixed to said pinion for rotating said pinion and said cam plate whereby rotation of said cam plate in engagement with said roller forces said pinion to move said support block from said elevated position to said lowered position.

5. The strapping tool in accordance with claim 4 in which said pinion has teeth for engaging said rack, said teeth extending for less than the complete circumference of said pinion whereby, when said handle is operated, said rack is not engaged by said teeth unless and until said pinion has rotated through a predetermined angle.

6. The strapping tool in accordance with claim 4 in which said camming plate includes a generally circular convex guide surface relative to said roller and includes a generally concave slot relative to said roller for receiving said roller and merging with said generally circular convex guide surface to define a convex camming surface whereby engagement of said roller with said convex camming surface during rotation of said pinion and cam plate in said first direction moves said support block from said elevated position to said lowered position and whereby engagement of said roller with said generally convex circular guide surface during rotation of said pinion and cam plate in said first direction maintains said support block in said lowered position.

7. The strapping tool in accordance with claim 6 in which said pinion has teeth extending in an arc only partially around said pinion and in which said cam plate is fixed to said pinion in an orientation wherein said pinion teeth do not engage said rack until said generally convex circular guide surface has engaged said roller.

8. The strapping tool in accordance with claim 2 in which said engagement member has a first portion having a generally circular arc surface defining said guide surface and a second portion projecting outwardly from said guide surface defining said abutment surface.

9. The strapping tool in accordance with claim 2 in which said pawl is pivotably mounted to said frame about an axis displaced from, and parallel to, said pinion axis.

10. The strapping tool in accordance with claim 9 in which said pawl has an engaging end and a non-engaging end, said engaging end adapted to be contacted by said engagement member.

11. The strapping tool in accordance with claim 10 in which said biasing means includes a spring connected under tension between said frame and said non-engaging end of said pawl to orient said pawl in said initial position.

12. A positive sealing assembly for a strapping tool of the type which crimps or notches a seal around overlapping strap ends extending in opposite directions in a tensioned strap loop around an article being tied and wherein the tool has a main frame; a sealer jaw assembly mounted for at least opening and closing movement about said seal relative to said frame; and a sealer jaw assembly actuator including (1) a reciprocative drive member adapted to be moved between a retracted position in which said jaw assembly is opened relative to said seal and an extended position in which said jaw assembly is engaged to crimp or notch said seal around the overlapping strap ends; (2) a rack on said drive member; and (3) a pinion mounted for engaging said rack for at least a portion of its circumference and adapted to be rotated about its axis in a first direction to move said drive member to said extended position and adapted to be rotated about its axis in a second, opposite direction to move said drive member to said retracted position; said positive sealing assembly comprising:

a pawl mounted on said frame to pivot about an axis in said first and second directions and biased against rotation in both directions to an initial position; and means mounted on said pinion for rotating therewith to pivot said pawl in said second direction when said pinion is rotated in said first direction and positioned for engaging said pawl to prevent rotation of said pinion in said second direction during engagement with said rack unless and until said pinion has been rotated through a predetermined angle.

13. A positive sealing assembly for a strapping tool of the type which crimps or notches a seal around overlapping strap ends extending in opposite directions in a strap loop around an article and wherein the tool has a main frame; a sealer jaw assembly mounted for at least opening and closing movement about said seal; and means for actuating said jaw assembly including at least an actuating member to be rotated about an axis in a first direction through a predetermined angle to fully close said jaw assembly and adapted to be rotated about an exis in a second, opposite direction to open said jaw assembly; said positive sealing assembly comprising:

a pawl mounted on said frame to pivot about an axis in said first and second directions and biased against rotation in both directions to an initial, unengaged position when said jaw assembly is both fully closed and fully opened; and an engagement means mounted on said actuating member, said engagement means having a guide surface defining a generally circular arc and having an abutment surface projecting outwardly from the guide surface, said engagement means being positioned for pivoting said pawl in said second direction when said actuating member is rotated in said first direction to close said jaw assembly and for engaging said pawl in a position pivoted from said initial position with said abutment surface to prevent rotation of said actuating member in said second direction until said actuating member has been rotated in said first direction through said predetermined angle to carry said engagement means past said pawl.

14. The assembly in accordance with claim 13 in whih said guide surface and said abutment surface lie outwardly of the actuating member rotational axis and extend less than completely around the axis, said guide surface located relative to said pawl to maintain said pawl in a position pivoted in said second direction from said initial position for less than a complete rotation of said actuating member and engagement means in said first direction, said abutment surface adapted to engage said pawl when the pawl is in a position pivoted by said guide surface in said second direction away from said initial position for preventing rotation of said actuating member in said second direction until said engagement means has been rotated in said first direction past said pawl and out of engagement therewith, whereby said pawl is biased back to said initial, unengaged position and may thereafter be engaged by said engagement means when said actuating member is rotated in said second direction to pivot said pawl about the axis in said first direction.

15. A strapping tool of the type which crimps or notches a seal around overlapping strap ends extending in opposite directions in a tensioned strap loop around an article being tied, said tool comprising:

a frame;

a sealer jaw assembly mounted for at least opening and closing movement about said seal relative to said frame;

a sealer jaw assembly actuator means for actuating the sealer jaw assembly; said sealer jaw assembly actuator means including at least an actuating member adapted to be rotated about an axis in a first direction through a predetermined angle to fully close said jaw assembly and adapted to be rotated about an axis in a second, opposite direction to open said jaw assembly;

a pawl mounted on said frame to pivot about an axis in said first and second directions and biased against rotation in both directions to an initial, unengaged position when said jaw assembly is both fully closed and fully opened; and an engagement means mounted on said actuating member, said engagement means having a guide surface defining a generally circular arc and having an abutment surface projecting outwardly from the guide surface said engagement means being positioned for pivoting said pawl in said second direction when said actuating member is rotated in said first direction to close said jaw assembly and for engaging said pawl in a position pivoted from said initial position with said abutment surface to prevent rotation of said actuating member is said second direction until said actuating member has been rotated in said first direction through said predetermined angle to carry said engagement means past said pawl.

16. The strapping tool in accordance with claim 15 in which said guide surface is generally smooth and in which said abutment surface has a first surface projecting outwardly from the guide surface and a second surface disposed at an angle to and extending from said first surface.

17. The strapping tool in accordance with claim 13 in which said guide surface is generally smooth and in which said abutment surface has a first surface projecting outwardly from the guide surface and a second surface disposed at an angle to, and extending from, said first surface.

* * * * *